US006481349B2

(12) United States Patent
Jehring et al.

(10) Patent No.: US 6,481,349 B2
(45) Date of Patent: Nov. 19, 2002

(54) APPARATUS FOR CORRECTLY REGISTERING AND MOUNTING OF A PRINTING PLATE

(75) Inventors: Arnfried Jehring, Coswig (DE); Christian Ziegenbalg, Weinböhla (DE); Ralf Zscheile, Friedenwald (DE); Andreas Techert, Coswig (DE)

(73) Assignee: Koenig & Bauer AG, Würzburg (DE)

( * ) Notice: Subject to any disclaimer, the term of this patent is extended or adjusted under 35 U.S.C. 154(b) by 0 days.

(21) Appl. No.: 09/821,289

(22) Filed: Mar. 29, 2001

(65) Prior Publication Data

US 2001/0025581 A1 Oct. 4, 2001

(30) Foreign Application Priority Data

Mar. 29, 2000 (DE) ..... 100 15 728

(51) Int. Cl.[7] ..... B41F 27/12; B41F 1/34

(52) U.S. Cl. ..... 101/415.1; 101/486; 101/477; 101/DIG. 36; 33/621

(58) Field of Search ..... 101/485, 486, 101/484, 409, 415.1, 477, 481, DIG. 36, 378, 382.1, 383; 33/614, 617, 618, 619, 621

(56) References Cited

U.S. PATENT DOCUMENTS 5,394,614 A * 3/1995 Lindner et al. ..... 101/415.1
5,461,980 A * 10/1995 Maejima ..... 101/415.1
6,135,027 A * 10/2000 Rudzewitz et al. ..... 101/415.1

* cited by examiner

*Primary Examiner*—Leslie J. Evanisko
(74) *Attorney, Agent, or Firm*—Goodwin Procter LLP

(57) ABSTRACT

In an apparatus for correctly registering mounting of a printing plate wherein the printing plate is mounted on a plate cylinder of a sheet fed press, the plate cylinder having a plate cylinder gap with a front plate clamping device, and a rear plate clamping and tensions device, and the front plate clamping device has registering punches, the registering punches being connected to means for securing and sensing the correct registration in a lateral and in a circumferential position in correspondence with registering punches in the printing plate, the improvement comprising the registering elements of front plate clamping device each having inserts insulated from the registering elements which contact the printing plate.

4 Claims, 3 Drawing Sheets

APPARATUS FOR CORRECTLY REGISTERING AND MOUNTING OF A PRINTING PLATE

FIELD OF INVENTION

The invention relates to an apparatus for correctly registering mounting of a printing plate on a plate cylinder of a sheet fed offset press.

BACKGROUND

An apparatus with electrically isolated registering pins at the front plate clamping device is known from Gennan utility model No. 77 28 905. The registering pins are connected with an electrical source and a signal transmitter. An electrical circuit is closed and the signal transmitter is activated when the registering pins contact the printing plate in the registering holes.

It is a disadvantage that the signal transmitter is also activated if the printing plate is not correctly registered. This is for instance the case when deformations or too large tolerances in the registering hole are causing skewing of the printing plate. The signal transmitter is also activated if, for instance, the printing plate is laterally misaligned so that the registering pins are touching the front edge of the printing plate. Is also possible when using a U-shaped printing plate which has registering holes open at its front edge when the registering pins are in contact with a side of the holes, without establishing a correct registration at the bottom of the openings.

The apparatus shown in European patent No. 581 212 B1 eliminates these disadvantages. The registering pins are also electrically isolated and connected to an electrical source and a signal transmitter. The registering pins have an additional partial isolation on their surface so that only a certain conducting section detects the bottom part of the registering hole.

It is a disadvantage of the apparatus that the registering pins are costly to manufacture. The insulated surface carries high loads and therefore either the surface or the entire registering pin has to be made from ceramics. This material cannot withstand the abrupt load changes that can occur, and these can cause breakage of the registering pin.

SUMMARY DESCRIPTION OF INVENTION

It is an object of the invention is to provide an apparatus to control the correctly registered position of a printing plate, which can be realized with simple means and can withstand abrupt load changes of the printing plate.

This object is solved according the invention by inserts allocated to registering elements, which are contacting the printing plate electrically isolated from the registering elements and are connected to a control unit. The plate cylinder has in the plate cylinder gap a plate clamping apparatus of a front plate clamping device and a rear plate clamping and tensions device. Registering elements for the lateral and circumferential direction are located in the front plate clamping device. These registering elements coincide with the registering punches in the printing plate and are connected to a control unit.

It is a particular advantage of the present invention that it employs a wear resistant and fracture-proof registering element which can be manufactured with low cost and guaranteeing a secure operation.

BRIEF DESCRIPTION OF THE DRAWING

The invention is described below in greater detail by embodiments of the invention, by reference being had to the drawing, wherein.

DETAILED DESCRIPTION

Figure 1:
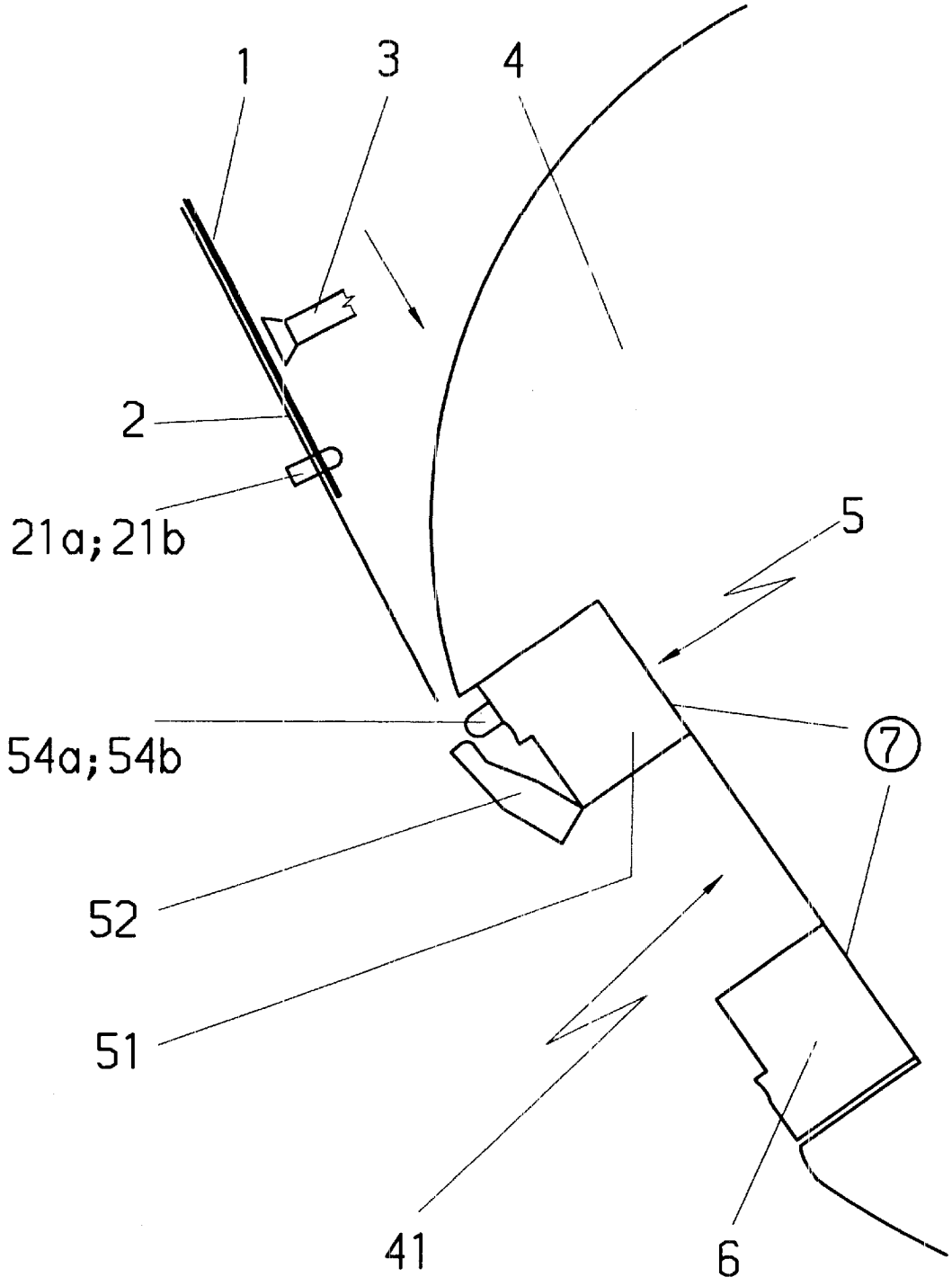
FIG. 1 is a schematic illustration of a plate cylinder with an open clamping rail during insertion of the printing plate.

FIG. 1 shows a printing plate 1 stored in a printing plate magazine 2. The printing plate 1 rests in two pre-registering pins 21*a*, 21*b* which are corresponding to the registering punches 12*a*, 12*b* (see FIG. 2) of the printing plate. The registering pins 21*a*, 21*b* are at a predetermined distance from each other.

The registering punches 12*a*, 12*b* have a different shape. The registering punch 12*a* has a flat bottom; the registering punch 12*b* has a curved radius at the bottom (see FIG. 2). Both have the same insertion bevel 121*a*, 121*b*. The pre-registering pins 21*a*, 21*b* have an appropriate shape corresponding to the registering punch as 12*a*, 12*b*. This means that a round pre-registering punch 12*b* fits the round pre-registering pin 21*b* (not shown) so that its radius matches the radius of the registering punch 12*b*. The registering punch 12*a* corresponds to the pre-registering pin 21*a* which is flat as is the contact zone in the registering punch 12*a* in the printing plate 1. The sides of the registering punch 12*a* do not contact the pre-registering pin 21*a*.

The printing plate magazine 2 is in its resting position is mounted on the frame of the printing press (not shown).

The plate cylinder 4 is also arranged in the frame. The plate or printing cylinder 4 carries on its surface the printing plate 1 supplied from the printing plate magazine 2 and has on its circumference a plate cylinder gap 41 stretching in the axial direction. A plate clamping device 7 is located in the plate cylinder gap 41. It has a front clamping device 5 and a rear clamping and tensions device 6 for the end of the plate. The front clamping device 5 has an upper clamping rail 52 and a lower clamping rail 51. The upper clamping rail 52 is fixedly mounted at the plate cylinder gap 41. The lower clamping rail 51 can be moved against the upper clamping rail 52 for clamping of the printing plate 1.

Figure 2:
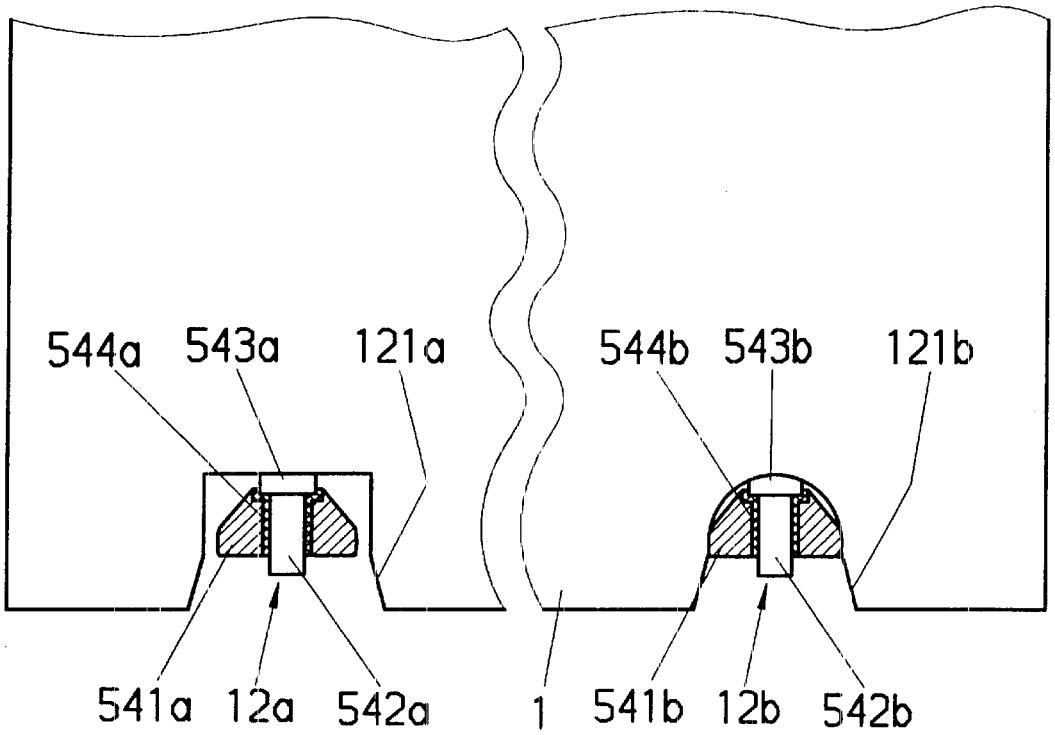
FIG. 2 is a schematic showing of the register-proof position of the printing plate at the registering pins.

The front clamping device 5 has registering elements embodied as registering pins 54*a*, 54*b* in the area of the clamping rails 51, 52. The registering pins 54*a*, 54*b* are in a finite distance from each other (as shown in FIG. 2) as the pre-registering pins 21*a*, 21*b* are also at a distance from each other. The registering pin 54*a* (not shown) has, as the pre-registering pin 21 a, a flat contact area at the bottom of the registering punch 12*a*. The registering pin 54*b* has, as the pre-registering pin 21*b*, a radius to accommodate the radius of the contact area of the registering punch 12*b*.

Figure 3:
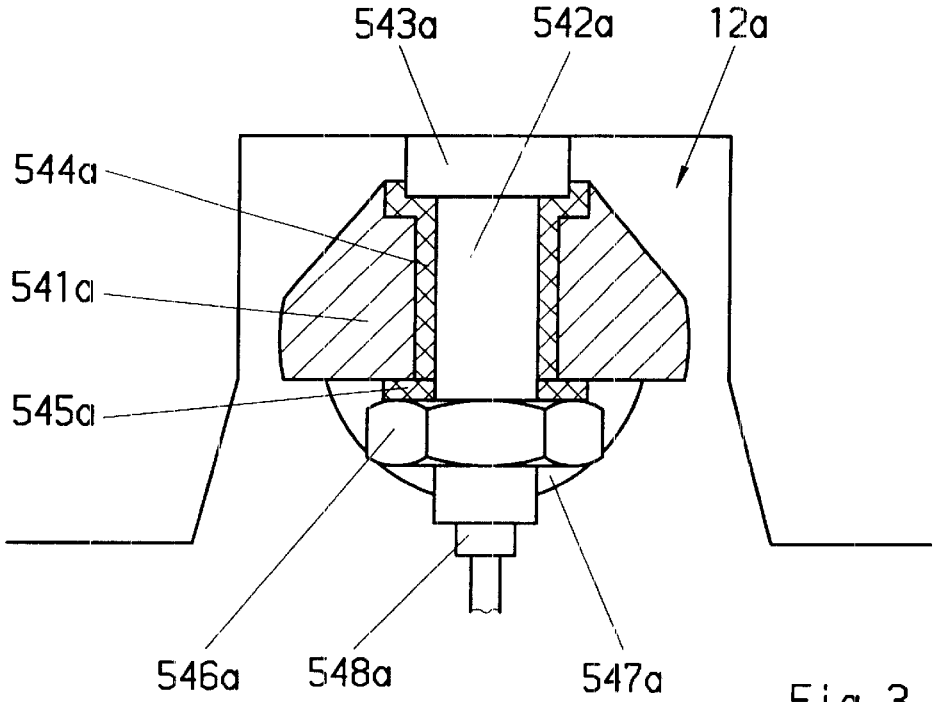
FIG. 3 is a schematic illustration of a registering pin with a flat touching head in top view.
Figure 4:
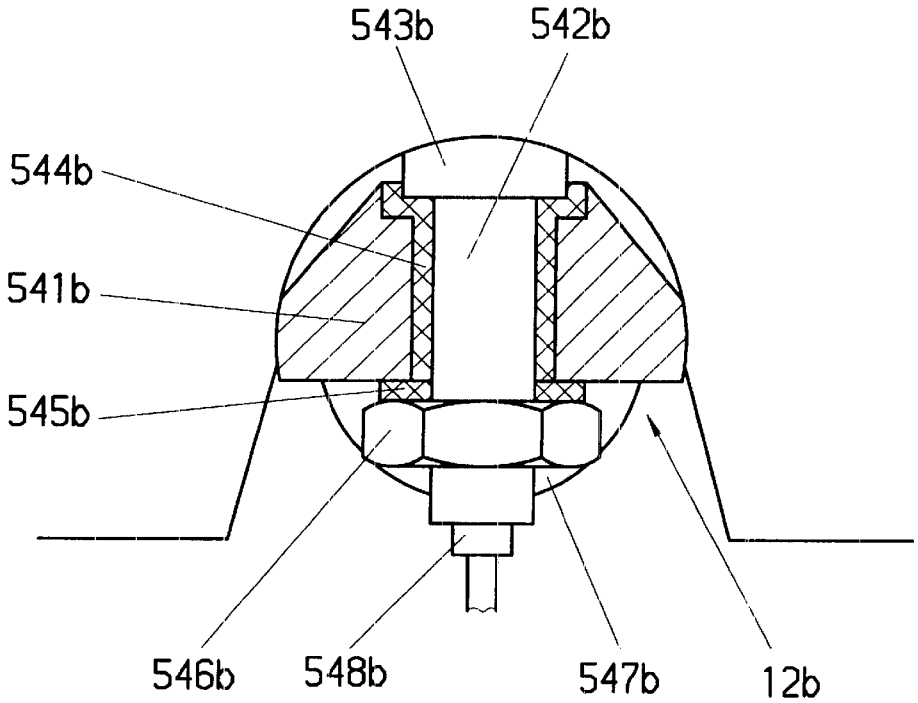
FIG. 4 is a schematic showing of a registering pin with a round touching head in top view.

The design of the registering pins 54*a*, 54*b* is shown in FIG. 3 and FIG. 4. Both registering pins 54*a*, 54*b* each have a foot 547*a*, 547*b* carrying an integral guiding body 541*a*, 541*b*. FIG. 3 and FIG. 4 show a top view in the direction of the axes of the registering pins 54*a*, 54*b* whereby these figures show a cross-section each of the guiding bodies 541*a*, 541*b*. Perpendicular to the axis of the registering pins 54*a*, 54*b* is in transportation direction of the printing plate 1 a bore is provided in the guiding bodies 541*a*, 541*b* for accommodating inserts 542*a*, 542*b*. These inserts 542*a*, 542*b* are electrically isolated from the guiding bodies 541*a*, 541*b* by isolation sleeves 544*a*, 544*b*. The inserts 542*a* and

542*b* each have an electrical connection 548*a*, 548*b*. The electrical connections 548*a*, 548*b* are each connected to a control unit (not shown). In the embodiment of the invention the inserts 542*a*, 542*b* are each attached to the respective guiding bodies 541*a*, 541*b* by a hexagonal nut 546*a*, 546*b* each, with each of which fastening the inserts 542*a*, 542*b* through an insulating washers 545*a*, 545*b* to the respective guiding body 541*a*, 541*b*.

Each insert 542*a*, 542*b* has a corresponding touching head 543*a*, 543*b*. Each of the touching heads 543*a*, 543*b* has different shape. The touching head 543*a* has a flat surface in its contact area to match the flat bottom of registering punch 12*a*. The touching head 543*b* has a contact area with a radius to accommodate the radius of registering punch 12*b*.

The printing plate 1 is secured in its position analogously to the positioning in the printing plate magazine 2: The guiding body 541*b* and the touching head 543*b* of the registering pin 54*b* have contact with the registering punch 12*b* in the printing plate 1 and the registering punch 12*a* has contacts at its bottom with the touching head 543*a*.

In the operation of the apparatus, the printing plate magazine 2 equipped with a printing plate 1 is moved from its resting position into the position for a printing plate change. The plate cylinder 4 is positioned to enable the insertion of the printing plate 1 in the front clamping device 5. FIG. 1 shows this position.

The printing plate 1 is pre-registered by the pre-registering system in the printing plate magazine 2. It is released from the printing plate magazine 2 by retracting the pre-registering pins 21*a*, 21*b* during the printing plate change. The transport device moves the printing plate 1 for instance in the illustrated embodiment with a suction head 3. Transportation by rollers or other means is also possible.

The suction head 3 picks up the printing plate 1 and transports it from the printing plate magazine 2 in the direction of the opened front clamping device 5. In this position the upper clamping rail 52 is removed from the lower clamping rail 51 to the maximum possible distance.

The printing plate 1 with its registering punches 12*a*, 12*b* is moved inside the front clamping device 5 to the registering pins 54*a*, 54*b*. The electrical contact between the conductive printing plate 1 and the registering pins 54*a* and 54*b* is closed if the printing platel reaches the registering position (see FIG. 2). An electrical signal to the printing machine control is generated when the set registering position analogous to FIG. 2 is obtained and the front clamping device 5 closes. Further steps for plate change 1 can now follow.

We claim:

1. In an apparatus for correctly registering and mounting a printing plate, wherein the printing plate is mounted on a plate cylinder of a sheet fed press, the plate cylinder having a plate cylinder gap with a front clamping device, and a rear plate clamping and tensions device, the printing plate having registering punches each having a bottom area, and the front plate clamping device having registering elements being connected to means for securing and sensing the correct registration in a lateral and in a circumferential position corresponding with said registering punches in the printing plate, the improvement comprising said registering elements of said front plate clamping device each comprising a guiding body made of metal adapted to range into one of said registering punches of said printing plate, an insert arranged in the guiding body and being adapted to contact the printing plate, and an insulating member arranged between the insert and the guiding body of each of the registering elements for electrically insulating the insert from the guiding body of each of the registering elements, wherein when the insert contacts the bottom area of one of the registering punches of the printing plate, an electrical signal is generated to indicate mounting of the printing plate.

2. The apparatus of claim 1, wherein each of said inserts are arranged contacting each of said bottom areas.

3. The apparatus of claim 1, wherein each of said inserts have a first end which faces said printing plate, and each of said inserts further comprises a touching head at each of said first ends, said touching heads contacting said registering punches in said bottom area.

4. The apparatus of claim 3, wherein each of said inserts has a second end which is opposite to said first end, and an electrical connection at respective ones of said second ends.

* * * * *